US005095859A

United States Patent [19]

Iwata et al.

[11] Patent Number: 5,095,859

[45] Date of Patent: Mar. 17, 1992

[54] SOHC TYPE INTERNAL COMBUSTION ENGINE

[75] Inventors: Takeshi Iwata; Takatoshi Aoki; Chihaya Sugimoto, all of Saitama, Japan

[73] Assignee: Honda Giken Kogyo Kabushiki Kaisha, Tokyo, Japan

[21] Appl. No.: 684,657

[22] Filed: Apr. 12, 1991

[30] Foreign Application Priority Data

Apr. 13, 1990 [JP] Japan ..... 2-97878

[51] Int. Cl.[5] ..... F01L 1/04; F01L 1/34

[52] U.S. Cl. ..... 123/90.27; 123/90.16; 123/308

[58] Field of Search ..... 123/90.16, 90.27, 308

[56] References Cited

U.S. PATENT DOCUMENTS

| | | | |
|---|---|---|---|
| 4,553,515 | 11/1985 | King et al. | 123/308 |
| 4,556,025 | 12/1985 | Morita | 123/90.27 |
| 4,561,391 | 12/1985 | Simko | 123/90.27 |
| 4,662,323 | 5/1987 | Moriya | 123/90.27 |
| 4,671,222 | 6/1987 | Gallot et al. | 123/90.27 |
| 4,741,302 | 5/1988 | Oda et al. | 123/90.27 |
| 4,844,022 | 7/1989 | Konno | 123/90.16 |
| 4,883,027 | 11/1989 | Oikawa et al. | 123/90.16 |
| 4,979,474 | 12/1990 | Morishita | 123/90.27 |
| 4,995,352 | 2/1991 | Machino | 123/90.27 |

FOREIGN PATENT DOCUMENTS

| | | | |
|---|---|---|---|
| 0258061 | 3/1988 | European Pat. Off. . | |
| 227911 | 9/1988 | Japan | 123/90.27 |
| 235645 | 9/1988 | Japan | 123/90.27 |
| 77738 | 3/1989 | Japan | 123/90.27 |

*Primary Examiner*—E. Rollins Gross
*Assistant Examiner*—Weilun Lo
*Attorney, Agent, or Firm*—Lyon & Lyon

[57] ABSTRACT

A SOHC type internal combustion engine includes a pair of intake valves and a pair of exhaust valves. The intake valve driving means comprises a plurality of rocker arms disposed adjacent one another, including a pair of driving rocker arms operatively connected separately to the intake valves and a connection switchover mechanism capable of switching-over the connection and disconnection of the adjacent rocker arms in accordance with the operational condition of the engine. The exhaust valve driving means comprises a pair of exhaust valve-side rocker arms operatively connected separately to the exhaust valves and disposed on opposite sides of the intake valve driving means in positions opposed to said cam shaft, respectively. In the intake valve driving means, the opening and closing mode of the intake valves can be changed in accordance with the operational condition of the engine by operation of the connection switchover mechanism, thereby providing an improvement in output from the engine. The intake valve driving means is constructed compactly by disposition of the plurality of rocker arms constituting the intake valve driving means adjacent one another in the positions opposed to the cam shaft, thereby enabling an effective and compact construction of the connection switchover mechanism provided in the intake valve driving means.

7 Claims, 13 Drawing Sheets

SOHC TYPE INTERNAL COMBUSTION ENGINE

BACKGROUND OF THE INVENTION

1. Field of the Invention

The field of the present invention is an single overhead cam (SOHC) type internal combustion engine comprising an intake valve driving means interposed between a single cam shaft rotatably disposed above a combustion chamber and a pair of intake valves for converting the rotational motion of the cam shaft into the opening and closing motions of the intake valves, an exhaust valve driving means interposed between the cam shaft and a pair of exhaust valves for converting the rotational motion of the cam shaft into the opening and closing motions of the exhaust valves, and a plug-insertion cylindrical portion for insertion of a spark plug which is to be disposed at a central portion of a ceiling surface of the combustion chamber.

2. Description of the Prior Art

Such SOHC type internal combustion engine is conventionally known, for example, from Japanese Patent Application Laid-open No. 57806/88 and the like.

In the above prior art, a plurality of intake valve-side rocker arms are interposed between a pair of intake valves and a cam shaft, and a pair of exhaust valve-side rocker arms are interposed between a pair of exhaust valves and the cam shaft, so that the pair of intake valves and the pair of exhaust valves are opened and closed by swingably driving the individual rocker arms by cams provided on the cam shaft. In addition, a connection switchover mechanism is provided in the intake valve-side rocker arms and capable of switching-over the connection and disconnection of the rocker arms, in order to improve the output performance of the engine by varying the opening and closing mode of the intake valves in accordance with the operational condition of the engine.

However, the intake valve-side rocker arms are adjacent one another in a location in which the connection switchover mechanism is provided, but the cams for the intake valve-side rocker arms and the cams for the exhaust valve-side rocker arms are provided alternately in an axial direction on the cam shaft and hence, the intake valve-side rocker arms cannot be arranged in a compact manner. This provides an increase in size of the connection switchover mechanism, resulting in an increase in weight of the intake valve-side rocker arm, in a difficulty of improving the dimensional accuracy of the connection switchover mechanism, and in a difficulty of disposing the slide contact portion of the intake valve-side rocker arm with the cam and the operatively connected position of the intake valve-side rocker arm to the intake valve together in a plane perpendicular to the swinging axis of the intake valve-side rocker arm, thereby causing an uneven or eccentric load to act on the intake valve-side rocker arm.

SUMMARY OF THE INVENTION

Accordingly, it is an object of the present invention to provide an SOHC type internal combustion engine including a pair of intake valves and a pair of exhaust valves, wherein the intake valve driving means can be constructed compactly, whereby the opening and closing mode of the intake valves can be changed in accordance with the operational condition of the engine.

To achieve the above object, according to the present invention, there is provided an SOHC type internal combustion engine comprising an intake valve driving means interposed between a single cam shaft rotatably disposed above a combustion chamber and a pair of intake valves for converting the rotational motion of the cam shaft into the opening and closing motions of the intake valves, an exhaust valve driving means interposed between the cam shaft and a pair of exhaust valves for converting the rotational motion of the cam shaft into the opening and closing motions of the exhaust valves, and a plug-insertion cylindrical portion disposed in a cylinder head for insertion or a spark plug which is to be disposed at a central portion of a ceiling surface of the combustion chamber, wherein the intake valve driving means comprises a plurality of rocker arms disposed adjacent one another and including a pair of driving rocker arms operatively connected separately to the intake valves, and a connection switchover mechanism capable of switching-over the connection and disconnection of the adjacent rocker arms in accordance with the operational condition of the engine, and the exhaust valve driving means comprises a pair of exhaust valve-side rocker arms operatively connected separately to the exhaust valves and disposed on opposite sides of the intake valve driving means with respect to the cam shaft.

With such construction, in the intake valve driving means, the opening and closing mode of the intake valves can be changed in accordance with the operational condition of the engine by switchingover the connection and disconnection of the plurality of rocker arms by operation of the connection switchover mechanism in accordance with the operational condition of the engine. This can contribute to an improvement in output from the engine. Moreover, the intake valve driving means can be constructed compactly by disposition of the plurality of rocker arms constituting the intake valve driving means adjacent one another in positions along and the cam shaft. As a result, the connection switchover mechanism provided in the intake valve driving means can be also constructed compactly.

It is another object of the present invention to insure a space for disposition of the plug insertion cylindrical portion, while providing a compact entire valve-operating system.

It is a further object of the present invention to provide a reduction in friction loss in the lower speed region in which the component, in the valve-operating system, of the friction loss in the entire engine constitutes a larger proportion and thus a reduction in friction loss in the entire engine, and to provide a compact construction of the intake valve driving means.

The above and other objects, features and advantages of the invention will become apparent from a reading of the following description of the preferred embodiments, taken in conjunction with the accompanying drawings.

BRIEF DESCRIPTION OF THE DRAWINGS

FIGS. 1 to 4 illustrate a first embodiment of the present invention, wherein FIG. 1 is a longitudinal sectional view of an essential portion, taken along a line I—I in FIG. 2;

FIG. 2 is a sectional view taken along a line II—II in FIG. 1;

FIG. 3 is a sectional view taken along a line III—III in FIG. 1; and

FIG. 4 is an enlarged sectional view taken along a line IV—IV in FIG. 1;

FIGS. 5 and 6 illustrate a second embodiment of the present invention, wherein FIG. 5 is a longitudinal sectional view of an essential portion, similar to FIG. 1; and FIG. 6 is a sectional view taken along a line VI—VI in FIG. 5;

FIGS. 7 to 9 illustrate a third embodiment of the present invention, wherein FIG. 7 is a longitudinal sectional view of an essential portion, similar to FIG. 1;

FIG. 8 is a sectional view taken along a line VIII—VIII in FIG. 7;

FIG. 9 is a bottom view of a cylinder head, taken along a line IX—IX in FIG. 7.

FIGS. 11 and 12 illustrate a fourth embodiment of the present invention, wherein FIG. 11 is a longitudinal sectional view of an essential portion, similar to FIG. 1; and FIG. 12 is a sectional view taken along a line XII—XII in FIG. 10.

DESCRIPTION OF THE PREFERRED EMBODIMENTS

The present invention will now be described by way of embodiments in connection with the accompanying drawings.

Figure 1:
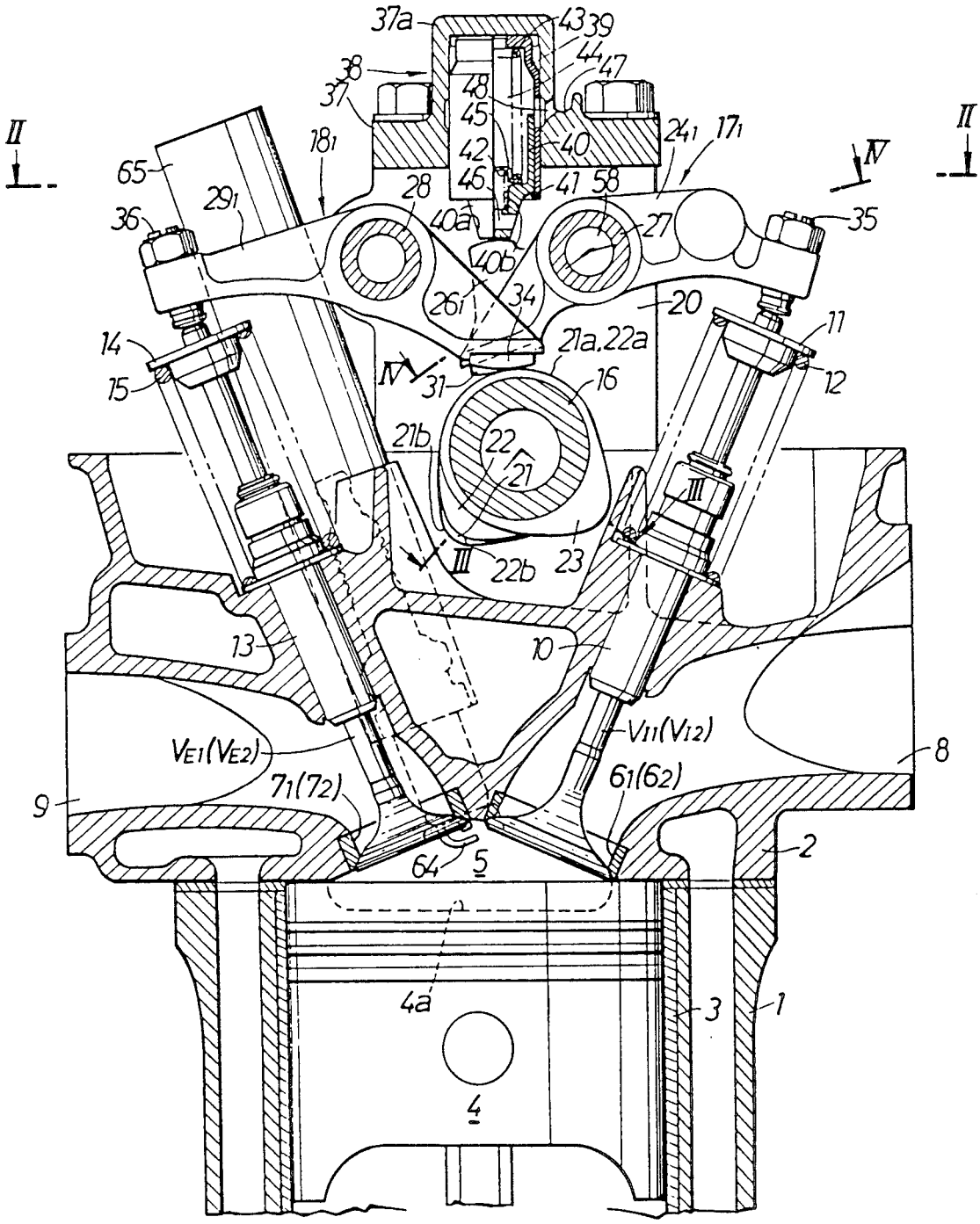

Referring first to FIG. 1 illustrating a first embodiment of the present invention, the essential portion of an engine body in an SOHC type multi-cylinder internal combustion engine is comprised of a cylinder block 1 and a cylinder head 2 coupled to an upper surface of the cylinder block 1. A piston 4 having a depression 4*a* on an upper surface thereof is slidably received in a cylinder 3 provided in the cylinder block 1, and a combustion chamber 5 is defined between the upper surface of the piston 4 and the cylinder head 2.

Figure 2:
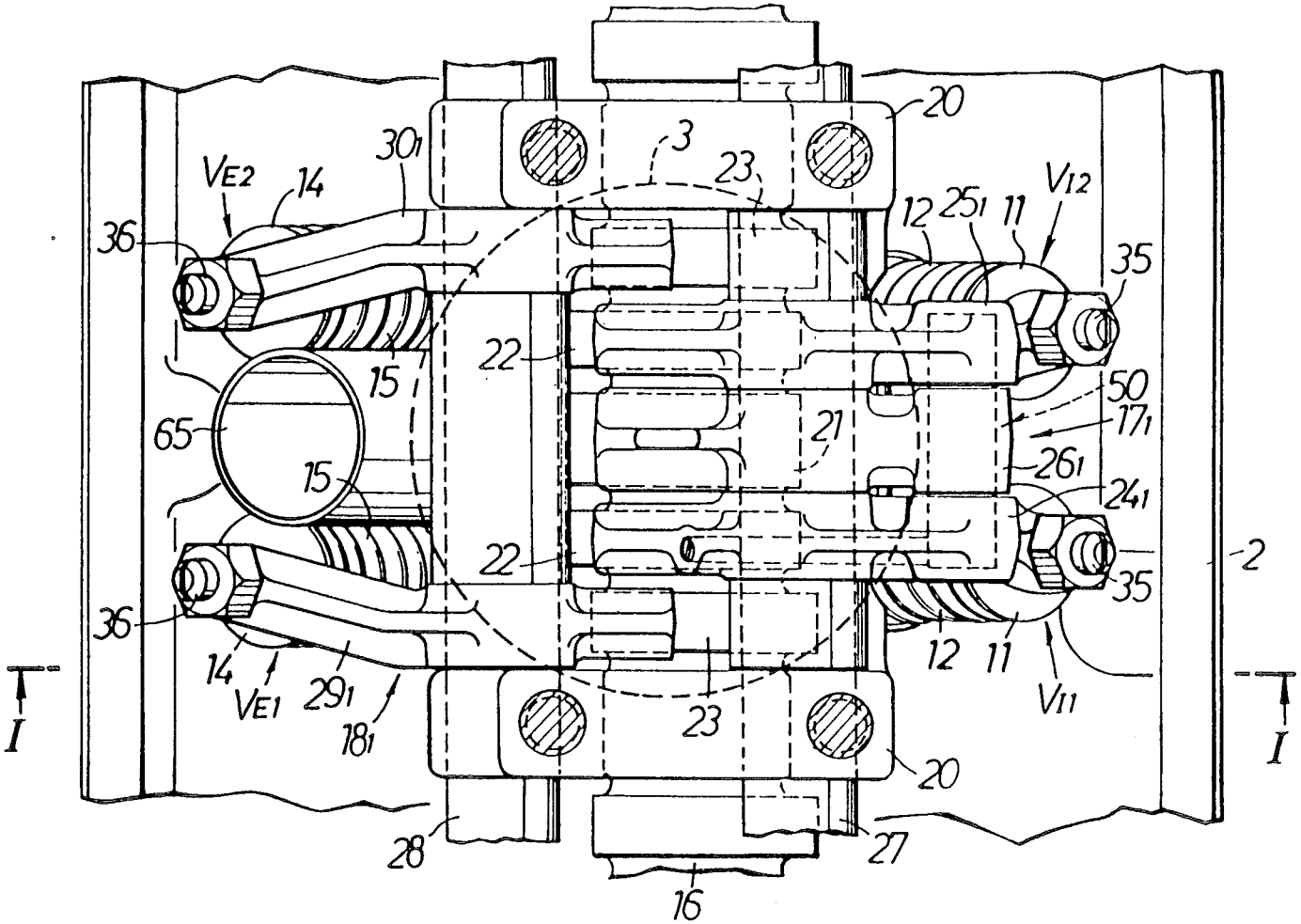

Referring also to FIG. 2, first and second intake valve opening $6_1$ and $6_2$ and first and second exhaust valve openings $7_1$ and $7_2$ are provided in the cylinder head 2 and opened into a ceiling surface of the combustion chamber 5. The intake valve openings $6_1$ and $6_2$ are connected to a single intake port 8 opened in one side surface of the cylinder head 2, and the exhaust valve openings $7_1$ and $7_2$ are connected to a single exhaust port 9 opened in the other side surface of the cylinder head 2. A first $V_{I1}$ and a second intake valve $V_{I2}$ are slidably received in a pair of cylindrical guides 10 disposed in the cylinder head 2, respectively, and adapted to open and close the first and second intake openings $6_1$ and $6_2$ independently. Coiled valve springs 12, 12 surrounding the intake valves $V_{I1}$ and $V_{I2}$ are provided between the cylinder head 2 and retainers 11, 11 fixed to upper ends of the intake valves $V_{I1}$ and $V_{I2}$ projecting from the corresponding cylindrical guides 10, respectively, so that the intake valves 12, 12 are biased upwardly, i.e., in valve-closing direction by the valve springs 12, 12. Exhaust valves $V_{E1}$ and $V_{E2}$ capable of opening and closing the first and second exhaust valve openings $7_1$ and $7_2$ independently are slidably received in a pair of cylindrical guides disposed in the cylinder head 2. Coiled valve spring 15, 15 surrounding the exhaust valves $V_{E1}$ and $V_{E2}$ are provided between the cylinder head 2 and retainers 14, 14 fixed to upper ends of the exhaust valves $V_{E1}$ and $V_{E2}$ projecting from the cylindrical guides 13, respectively, so that the exhaust valves $V_{E1}$ and $V_{E2}$ are based upwardly, i.e., in valve-closing direction by the valve springs 15, 15.

An intake valve driving means $17_1$, is interposed between the intake valves $V_{I1}$ and $V_{I2}$ and a single cam shaft 16 operatively connected to a crankshaft (not shown) at a reducing ratio of ½ for converting the rotational motion of the cam shaft 16 into the opening and closing motions of the intake valves $V_{I1}$, and $V_{I2}$, and an exhaust valve driving means $18_1$ is interposed between the exhaust valves $V_{E1}$ and $V_{E2}$ and the cam shaft 16 for converting the rotational motion of the cam shaft 16 into the opening and closing motions of the intake valves $V_{E1}$ and $V_{E2}$.

Referring also to FIG. 2, the cam shaft 16 is rotatably carried by the cylinder head 2 and a holder 20 coupled to the cylinder head 2 and has a horizontal axis perpendicular to the axis of the cylinder 3. The cam shaft 16 is integrally provided with a higher speed cam 21 and lower speed cams 22, 22 adjacent to opposite sides of the higher speed cam 21 and further is integrally provided with exhaust valve cams 23, 23 on opposite sides the lower speed cams 22, 22. The higher speed cam 21 has a shape permitting the intake valves $V_{I1}$ and $V_{I2}$ to be opened and closed in a higher speed operational region of the engine and includes a base circle portion 21*a* and a raised portion 21*b* projecting radially outwardly from the base circle portion 21*a*. Each of the lower speed cams 22 has a shape permitting the intake valves $V_{I1}$ and $V_{I2}$ to be opened and closed in a lower speed operational region of the engine and includes a base circle portion 22*a* and a raised portion 22*b* projecting radially outwardly of the cam shaft 16 in a projecting amount smaller than that of the raised portion 21*b* of the higher speed cam 21 and over a region of a central angle smaller than that of the raised portion 21*b*. Further, the exhaust valve cam 23 has a shape permitting the exhaust valves $V_{E1}$ and $V_{E2}$ to be opened and closed in all the operational conditions of the engine.

The intake valve driving means $17_1$ comprises a first driving rocker arm $24_1$, operatively connected to the first intake valve $V_{I1}$, a second rocker arm $25_1$ operatively connected to the second intake valve $V_{12}$, and a free rocker arm $26_1$, disposed between the driving rocker arms $24_1$ and $25_1$. The rocker arms $24_1$, $25_1$ and $26_1$ are swingably carried by a rocker arm shaft 27 which is fixedly supported on a holder 20 and has an axis parallel to the cam shaft 16 above the cam shaft 16. The exhaust valve driving means $18_1$ comprises a pair of exhaust valve-side rocker arms $29_1$ and $30_1$ swingably carried on a rocker arm shaft 28 which is fixedly supported on the holder 20 parallel to the rocker arm shaft 27 above the cam shaft 16.

In the intake valve driving means $17_1$, a cam slipper 31 is provided at one end of the first driving rocker arm $24_1$ and adapted to come into sliding contact with the lower speed cam 22 provided on the cam shaft 16, and a cam slipper (not shown) is provided at one end of the second driving rocker arm $25_1$ to come into sliding contact with the lower speed cam 22 provided on the cam shaft 16. A cam slipper (not shown) is provided on the free rocker arm $26_1$ to come into sliding contact with the higher speed cam 21 provided on the cam shaft 16. In addition, a cam slipper 34 is provided on one end of each of the exhaust valve-side rocker arms $29_1$ and $30_1$ to come into sliding contact with corresponding one of the exhaust valve cams 23, 23 provided on the cam shaft 16.

A tappet screw 35 is threadedly engaged in the other end of each of the first and second driving arms $24_1$ and $25_1$ of the intake valve driving means $17_1$ for advancing and retreating movement to abut against an upper end of each of the intake valves $V_{I1}$ and $V_{I2}$, so that the intake valves $V_{I1}$ and $V_{I2}$ are opened and closed in response to the swinging movement of the driving rocker arms $24_1$ and $25_1$. A tappet screw 36 is also threadedly engaged in the other end of each of the rocker arms $29_1$ and $30_1$ in the exhaust valve driving means $18_1$ to abut against an upper end of each of the exhaust valves $V_{E1}$ and $V_{E2}$, so that the exhaust valves $V_{E1}$ and $V_{E2}$ are opened and closed in response to the swinging movement of the rocker arms $29_1$ and $30_1$.

Referring again to FIG. 1, a support plate 37 is fixedly mounted on the holder 20 above the cylinder head 2 in a position corresponding to between adjacent cylinders 3 to cover the rocker arm shafts 27 and 28. The support plate 37 is provided with a lost motion mechanism 38 for resiliently biasing the free rocker arm $26_1$ toward the higher speed cam 21.

The lost motion mechanism 38 comprises a bottomed cylindrical guide member 39 fitted in the support plate 37, a piston 40 slidably received in the guide member 39 and having an abutment portion shaped convergently at an end closer to the free rocker arm $26_1$ for abutment against the free rocker arm $26_1$, a stopper 41 detachably secured to an inner surface of the guide member 39 closer to an opened end to engage the piston 40, and a first spring 42 and a second spring 43 interposed between the piston 40 and the guide member 39 to resiliently bias the piston 40 in a direction to abut against the free rocker arm $26_1$.

The support plate 37 is provided with a bottomed cylindrical portion 37*a* opened downwardly in a location corresponding to the free rocker arm $26_1$, and the guide member 39 is fitted into the bottomed cylindrical portion 37*a* with its opened end turned downwardly. A spring chamber 44 is defined between the piston 40 and the guide member 39. The first spring 42 has a relatively small spring constant and is provided in a compressed manner between a retainer 45 contained in the spring chamber 44 and the piston 40, and the second spring 43 has a relatively large spring constant and is provided in a compressed manner between the retainer 45 and a closed end of the guide member 39.

The bottomed small hole 40*b* is made coaxially in an inner surface of a closed end of the piston 40, and the first spring 42 having a relatively small spring constant is contained in the small hole 40*b*, whereby falling of the first spring is prevented. The abutment portion 40*a* of the piston 40 also has an air vent hole 46 made therein into a cross-shape opening in an outer surface of the abutment portion 40*a* and communicating with the outside of the spring chamber 44, in order to prevent the interior of the spring chamber 44 from being pressurized and depressurized during sliding movement of the piston 40.

Further, an oil groove 47 is provided on the support plate 37 to extend in parallel to the cam shaft 16 adjacent a base end of the bottomed cylindrical portion 37*a*, and an oil passage 48 is provided in the base end of the bottomed cylindrical portion 37*a* and the guide member 39 for conducting an oil flowing through the oil groove 47 into the spring chamber 44. Thus, lubricating oil can be supplied between the piston 40 and the guide member 39 by flowing of the lubricating oil through the oil groove 47.

Figure 4:
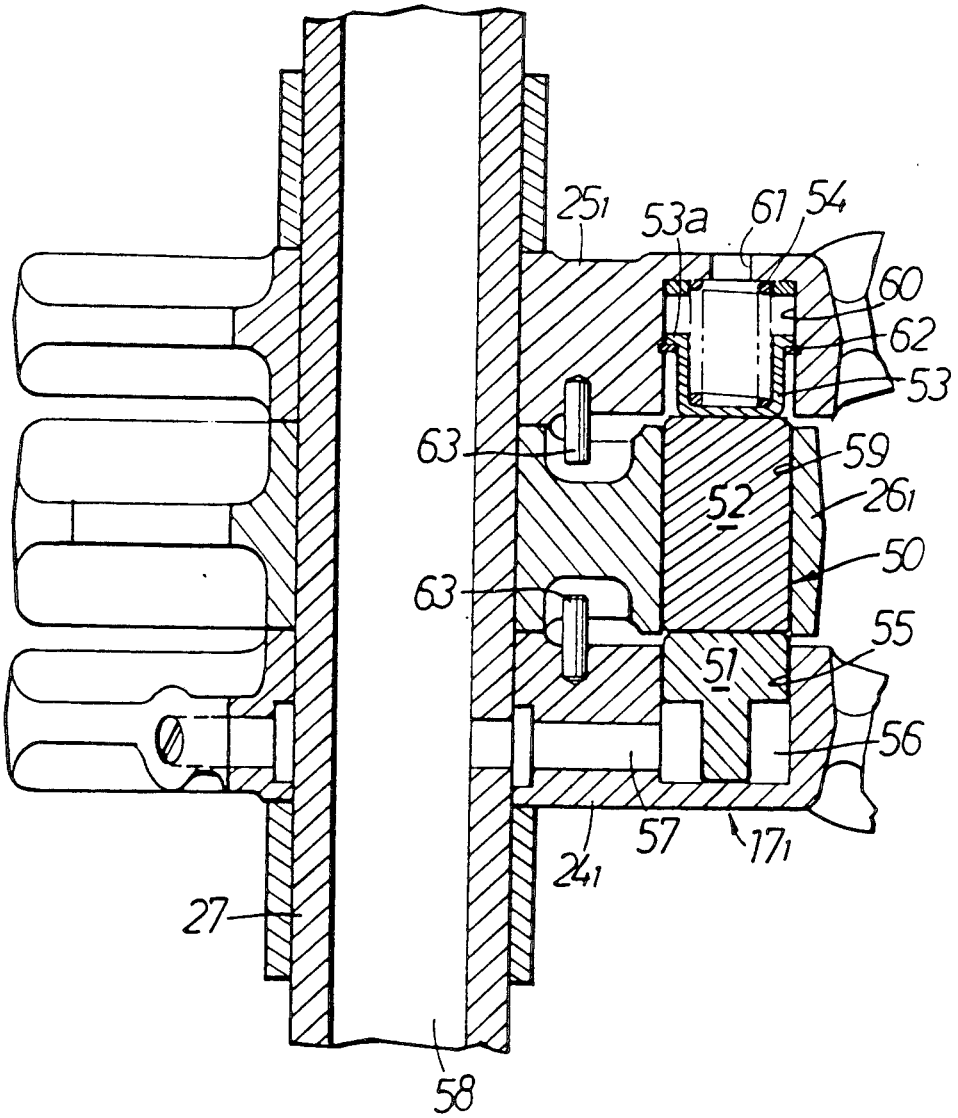

Referring to FIG. 4, the intake valve driving means $17_1$ is provided with a connection switchover mechanism 50 capable of switching-over the connection and disconnection of the rocker arms $24_1$ to $26_1$ in accordance with the operational condition of the engine.

The connection switchover mechanism 50 comprises a first connecting piston 51 capable of connecting the first driving rocker arm $24_1$ and the free rocker arm $26_1$, a second connecting piston 51 capable of connecting the free rocker arm $26_1$ and the second driving rocker arm $25_1$, a restricting member 53 for restricting the movement of the first and second connecting pistons 51 and 52, and a return spring 54 for biasing the pistons 51 and 52 and the restricting member 53 toward a disconnection position.

A first bottomed guide hole 55 is provided in the first driving rocker arm $24_1$ in parallel to the rocker arm shaft 27 and opened toward the free rocker arm $26_1$. The first connecting piston 51 is slidably received in the first guide hole 55, and a hydraulic pressure chamber 56 is defined between one end of the first connecting piston 51 and a closed end of the first guide hole 55. A communication passage 57 is also provided in the first driving rocker arm $24_1$ to communicate with the hydraulic pressure chamber 56, and a hydraulic pressure supply passage 58 is provided in the rocker shaft 27 and leads to a hydraulic pressure supply source which is not shown. The hydraulic pressure supply passage 58 continually communicates with the communication passage 57 and the hydraulic pressure chamber 56 despite the swinging condition of the first driving rocker arm $24_1$ by means of an internal groove (not numbered) in the first driving rocker arm $24_1$.

A guide hole 59 corresponding to the first guide hole 55 is provided in the free rocker arm $26_1$ to extend between opposite side surfaces thereof in parallel to the rocker arm shaft 27, and the second connecting piston 52 abutting at one end thereof against the other end of the first connecting piston 51 is slidably received in the guide hole 59.

A second bottomed guide hole 60 corresponding to the guide hole 59 is provided in the second driving rocker arm $25_1$ in parallel to the rocker arm shaft 27 and is open toward the free rocker arm $26_1$. The bottomed cylindrical restricting member 53 abuts against the other end of the second connecting piston 52 and is slidably received in the second guide hole 60. The restricting member 53 is disposed with its open end turned to the closed end of the second guide hole 60, and a collar 53*a* projecting radially outwardly is in sliding contact with an inner surface of the second guide hole 60 at such open end. The return spring 54 is mounted in a compressed manner between the closed end of the second guide hole 60 and a closed end of the restricting member 53, so that the pistons 51 and 52 and the restricting member 53 abut against one another and are biased toward the hydraulic pressure chamber 56 by the spring force of the return spring 54. Moreover, a communication hole 61 for venting air and oil is provided at the closed end of the second guide hole 60.

A retaining ring 62 is fitted on an inner surface of the second guide hole 60 and is capable of engaging the collar 53*a* of the restricting member 53, so that the restricting member 53 is inhibited from slipping out of the second guide hole 60 by the retaining ring 62. Moreover, the fitted position of the retaining ring 62 is determined to inhibit the further movement of the restricting member 53 toward the free rocker arm $26_1$ from a state in which it is in abutment against the free rocker arm $26_1$ in a location corresponding to a plane between the free rocker arm 26, and the second driving rocker arm $25_1$.

In the connection switchover mechanism 50, a swing pin 63 is embedded in the side surface of each of the first and second driving rocker arms $24_1$ and $25_1$ which is facing the free rocker arm $26_1$ to engage the free rocker arm $26_1$ while permitting the relatively swinging movement of the driving rocker arms $24_1$ and $25_1$ with the free rocker arm $26_1$.

Referring again to FIGS. 1 and 2, a spark plug 64 is disposed at a central portion of a ceiling surface of the combustion chamber 5. A plug pipe 65 is disposed in the cylinder head 2 and serves as a cylindrical plug-insertion portion for insertion of the spark plug 64. The pair of exhaust valve-side rocker arms $29_1$ and $30_1$ constituting the exhaust valve driving means $18_1$ are disposed for sliding contact with the exhaust valve cams 23, 23 of the cam shaft 16 on opposite sides of the intake rocker arms $24_1$, $25_1$ and $26_1$ which are disposed adjacent one another to constitute the intake valve driving means $17_1$. This ensures that a relatively wide space is provided between the exhaust valve rocker arms $29_1$ and $30_1$ and the exhaust valves $V_{E1}$ and $V_{E2}$ can be disposed at a relatively wide distance apart from each other. Therefore, the plug pipe 65 is positioned in the cylinder head 2 in such a manner that the axis thereof is disposed between the exhaust valves $V_{E1}$ and $V_{E2}$, i.e., located between the exhaust valves $V_{E1}$ and $V_{E2}$ as well as between the exhaust valve-side rocker arms $29_1$ and $30_1$. The plug pipe 65 is inclined so that the upper portion thereof is spaced from the cam shaft 16. The spark plug 64 inserted into the plug pipe 65 is threadedly mounted in the cylinder head 2 at the central portion of the ceiling surface of the combustion chamber 5.

The operation of the first embodiment will be described. When the engine is in a lower speed operation, the hydraulic pressure in the hydraulic pressure chamber 56 in the connection switchover mechanism 50 is released, and the pistons 51 and 52 and the restricting member 53 are in their disconnected states in which they have been moved to the maximum extent toward the hydraulic pressure chamber 56 by the spring force of the return spring 54. In such condition, the abutment surfaces of the first and second connecting pistons 51 and 52 are in positions between the first driving rocker arm $24_1$ and the free rocker arm $26_1$, while the abutment surfaces of the second connecting piston 52 and the restricting member 53 are in positions between the free rocker arm $26_1$ and the second driving rocker arm $25_1$. Therefore, the rocker arms $24_1$, $25_1$ and $26_1$ are in a disconnected state to allow relative angular displacement.

In such disconnected condition, the rotation of the cam shaft 16 causes the first and second driving rocker arms $24_1$ and $25_1$ to be swung in response to the sliding contact with the lower speed cams 22, 22, so that the intake valves $V_{I1}$ and $V_{I2}$ are opened and closed at a timing and a lift amount corresponding to the shape of the lower speed cams 22, 22. During this time, the free rocker arm $26_1$ is swung in response to the sliding contact with the higher speed cam 21, but the swinging movement thereof exerts no influence on the first and second driving rocker arms $24_1$ and $25_1$. In addition, the exhaust valves $V_{E1}$ and $V_{E2}$ are opened and closed at a timing and a lift amount corresponding to the shape of the exhaust valve cams 23, 23.

During a higher speed operation of the engine, a higher hydraulic pressure is supplied to the hydraulic pressure chamber 56. This causes the first and second connecting pistons 51 and 52 as well as the restricting member 53 in the connection switchover mechanism 50 of the intake valve driving means $17_1$ to be moved toward the connecting positions against the spring force of the return spring 54, so that the first connecting piston 51 is fitted into the guide hole 59, while at the same time, the second connecting piston 52 is fitted into the second guide hole 60, thereby connecting the rocker arms $24_1$, $25_1$ and $26_1$. At this time, the amount of swinging movement of the free rocker arm $26_1$ in sliding contact with the higher speed cam 21 is largest and therefore, the first and second driving rocker arms $24_1$ and $25_1$ are swung with the free rocker arm $26_1$, and the intake valves $V_{I1}$ and $V_{I2}$ are opened and closed at a timing and a lift amount corresponding to the shape of the higher speed cam 21.

During this higher speed operation, the exhaust valveside rocker arms $29_1$ and $30_1$ still open and close the exhaust valves $V_{E1}$ and $V_{E2}$ at a timing and a lift amount corresponding to the shape of the exhaust valve cams 23, 23, as during the lower speed operation.

It is possible to provide an improvement in output from the engine with a valve operating characteristic adapted for the operational condition of the engine by changing the opening and closing mode of the intake valves $V_{I1}$ and $V_{I2}$ between the higher and lower speed operations in this manner.

In such an internal combustion engine, in the position corresponding to the cam shaft 16, the rocker arms $24_1$, $25_1$ and $26_1$ constituting the intake valve driving means $17_1$ are disposed adjacent one another and can be arranged together in a compact manner. It follows that the connection switchover mechanism 50 is also arranged in a compact manner. This enables not only an easy improvement in dimensional accuracy of the components of the connection switchover mechanism 50 in order to provide a smooth operation of the connection switchover mechanism 50, but also contributes to a reduction in the weight of the rocker arms $24_1$, $25_1$ and $26_1$. Moreover, the sliding contact positions of the first and second driving rocker arms $24_1$ and $25_1$ with the lower speed cams 22, 22 and the operatively connected positions of these rocker arms to the intake valves $V_{I1}$ and $V_{I2}$ can be established within a plane substantially perpendicular to the axis of the rocker arm shaft 27, thereby avoiding the action of an uneven or eccentric load on the first and second rocker arms $24_1$ and $25_1$.

The plug pipe 65 is disposed in the cylinder head 2 with its axis located between the exhaust valves $V_{E1}$ and $V_{E2}$ thereby effectively utilizing the space produced by positioning the exhaust valve-side rocker arms $29_1$ and $30_1$ on opposite sides of the intake valve driving means $17_1$. Therefore, it is possible to make the entire arrangement more compact.

Figure 5:
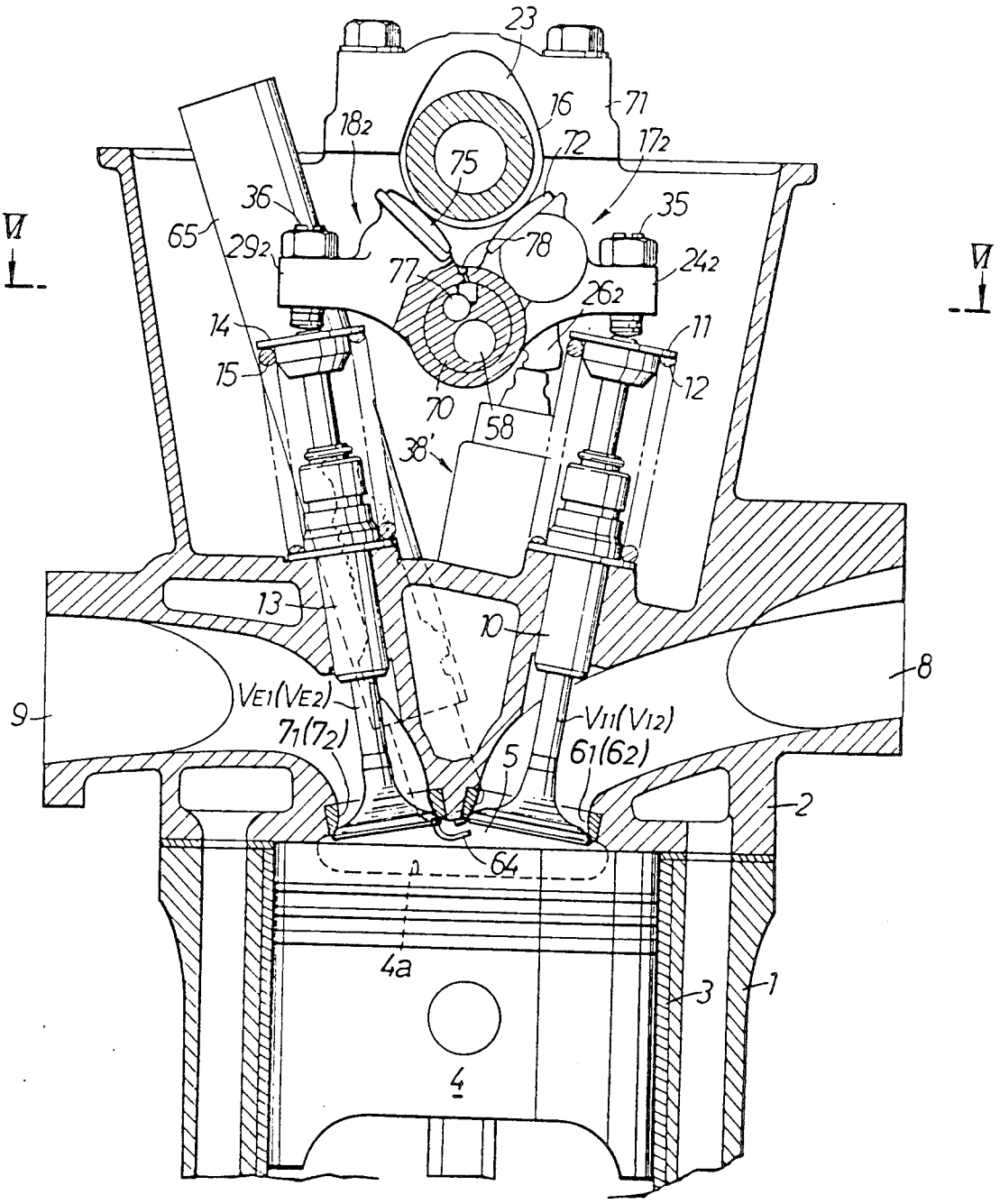
Figure 6:
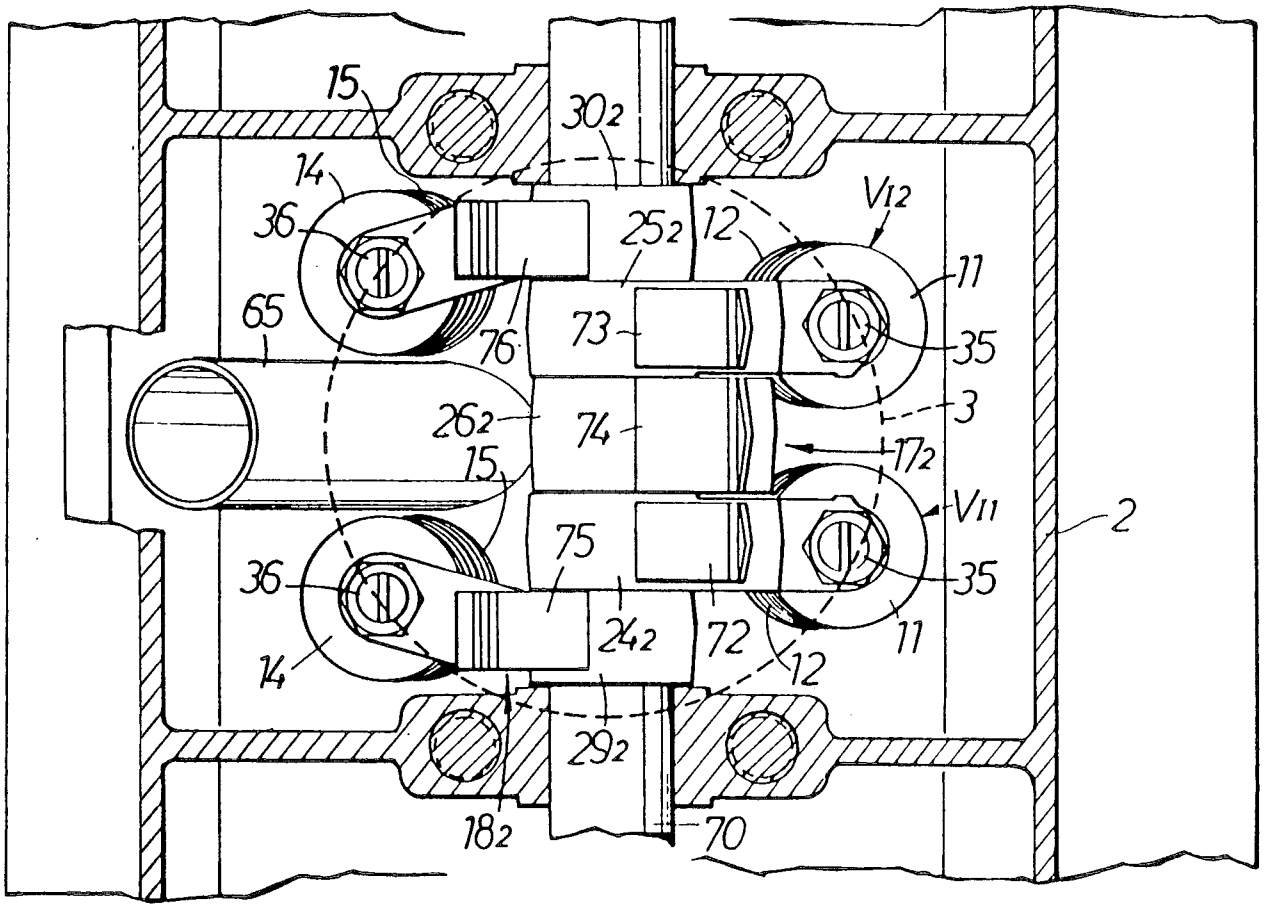

FIGS. 5 and 6 illustrate a second embodiment of the present invention, wherein parts that are similar or identical to those in the previously described first embodiment are identified by the same reference characters.

Figure 3:
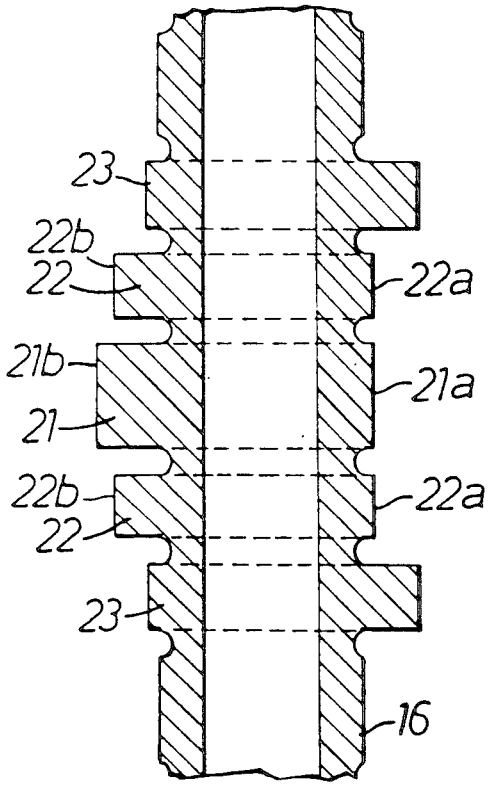

A cam shaft 16 is rotatably carried by the cylinder head 2 and a cam holder 71 coupled to the cylinder head 2. Integrally provided on the cam shaft 16 in an arrangement similar to that shown in FIG. 3 illustrating the first embodiment are a higher speed cam 21, lower speed cams 22, 22 on opposite sides of the higher speed cam 21, and exhaust valve-side cams 23, 23 on opposite sides of the lower speed cams 22, 22. A rocker arm shaft 70 parallel to the cam shaft 16 is fixedly supported in the cylinder head 2 below the cam shaft 16. An intake valve driving means $17_2$ is provided between the intake valves $V_{I1}$ and $V_{I2}$ and the cam shaft 16 for converting the rotational motion of the cam shaft 16 to the opening and closing motions of the intake valves $V_{I1}$ and $V_{I2}$, and an exhaust valve driving means $18_2$ is provided between the exhaust valves $V_{E1}$ and $V_{E2}$ and the cam shaft 16 for converting the rotational motion of the cam shaft 16 to the opening and closing motions of the exhaust valves $V_{E1}$ and $V_{E2}$.

The intake valve driving means $17_2$ comprises a first driving rocker arm $24_2$ operatively connected to the first intake valve $V_{I1}$, a second driving rocker arm $25_2$ operatively connected to the second intake valve $V_{I2}$, and a free rocker arm $26_2$ disposed between the driving rocker arms $24_2$ and $25_2$. The rocker arms $24_2$, $25_2$ and $26_2$ are swingably carried at their base ends on the rocker arm shaft 70. The exhaust valve driving means $18_2$ comprises exhaust valve-side rocker arms $29_2$ and $30_2$ swingably carried at their base ends on the rocker arm shaft 70 and operatively connected separately to the exhaust valves $V_{E1}$ and $V_{E2}$.

In the intake valve driving means $17_2$, a cam slipper 72 is provided at an intermediate and upper portion of the first driving rocker arm $24_2$ to come into sliding contact with the lower speed cam 22 (see FIG. 3); a cam slipper 73 is provided at an intermediate and upper portion of the second driving rocker arm $25_2$ to come into sliding contact with the lower speed cam 22 (see FIG. 3), and a cam slipper 74 is provided on the free rocker arm $26_2$ to come into sliding contact with the higher speed cam 21 (see FIG. 3). In addition, cam slippers 75 and 76 are provided on intermediate and upper portions of the exhaust valve-side rocker arms $29_2$ and $30_2$ to come into sliding contact with the exhaust valve cams 23, 23 (see FIG. 3).

A lost motion mechanism 38' having the basically same construction as the lost motion mechanism 38 in the first embodiment is provided in the cylinder head 2 to resiliently bias the free rocker arm $26_2$ in the intake valve driving means $17_2$ toward the cam shaft 16.

Further, a connection switchover mechanism (not shown) having the basically same construction as the connection switchover mechanism 50 in the first embodiment is provided in the intake valve driving mechanism $17_2$ to switchover the connection and disconnection of the rocker arms $24_2$, $25_2$ and $26_2$ in accordance With the operational condition of the engine.

A lubricating oil supply passage 77 is provided in the rocker arm shaft 70 parallel to the hydraulic pressure supply passage 58, and injecting nozzles 78 are provided at base portions of the rocker arms $24_2$, $25_2$, $26_2$, $29_2$ and $30_2$ respectively to communicate with the lubricating oil supply passage 77 in accordance with the swing positions of the rocker arms $24_2$, $25_2$, $26_2$, $29_2$ and $30_2$ in order to eject a lubricating oil from the lubricating oil supply passage 77 toward their sliding contact portions with the cam shaft 16.

It should be noted that the pair of rocker arms $29_2$ and $30_2$ constituting the exhaust valve driving means $18_2$ are disposed on opposite sides of the intake valve driving means $17_2$ in their positions opposed to the cam shaft 16. Therefore, it is possible to insure a relatively wide space between the exhaust valve-side rocker arms $29_2$ and $30_2$ as in the previous first embodiment and it is also possible to dispose the exhaust valves $V_{E1}$ and $V_{E2}$ at a relatively wide distance spaced from each other, so that the plug pipe 65 may be disposed in the cylinder head 2 between the exhaust valves $V_{E1}$ and $V_{E2}$ as well as between the exhaust valve-side rocker arms $29_2$ and $30_2$.

Thus, with such second embodiment, it is possible to insure a space for the plug pipe 65 with a compact entire arrangement, notwithstanding the provision of the connection switchover mechanism in the intake valve driving means $17_2$.

FIGS. 7 to 9A illustrate a third embodiment of the present invention, wherein parts similar or identical to those in the previous embodiments are identified by the same reference characters.

Figure 7:
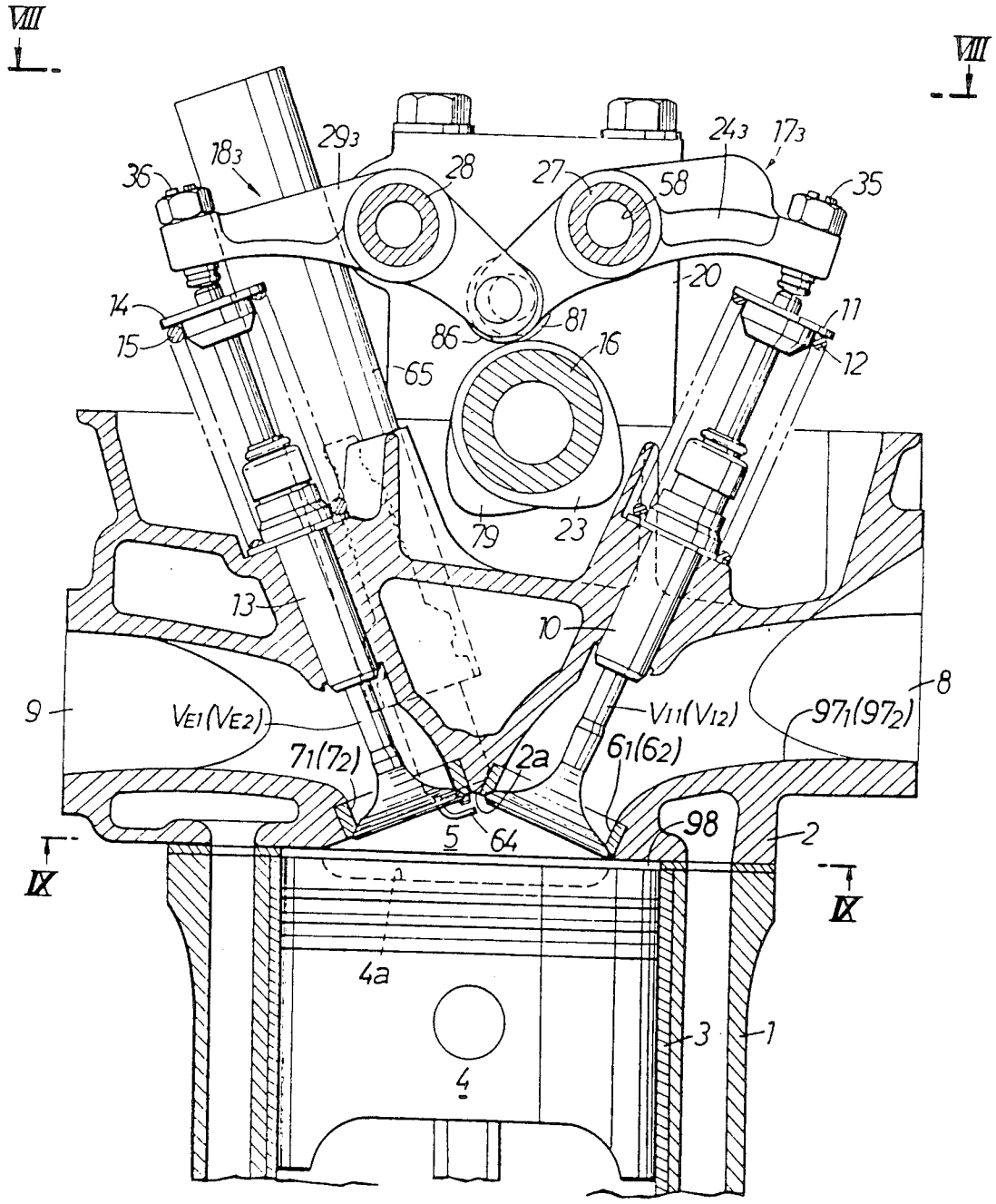
Figure 8:
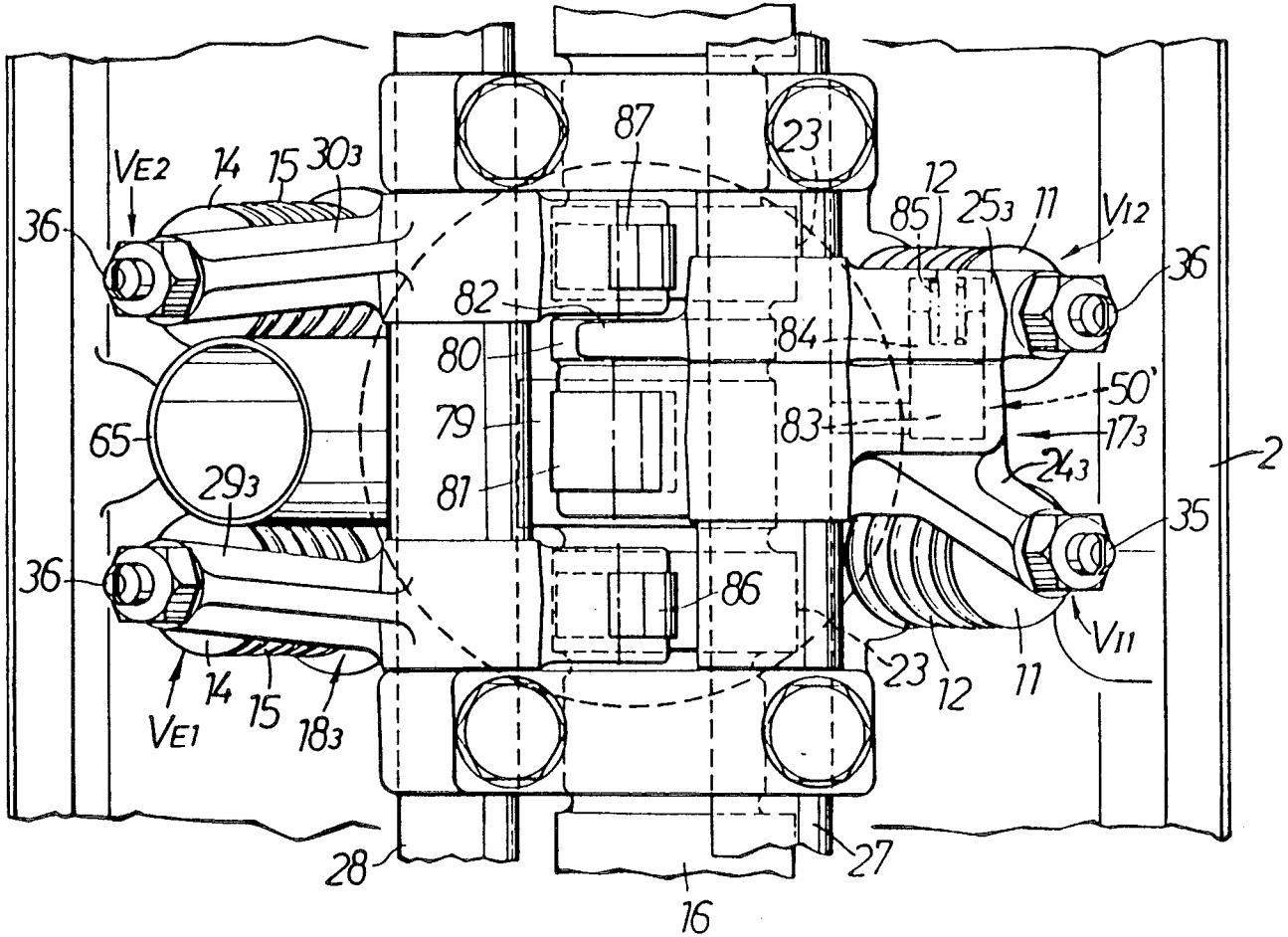

Referring first to FIGS. 7 and 8, a cam shaft 16 is rotatably carried by a cylinder head 2 and a holder 20 coupled to the cylinder head 2. An intake valve driving means $17_3$ is provided between the cam shaft 16 and the intake valves $V_{I1}$ and $V_{I2}$ for converting the rotational motion of the cam shaft 16 into the opening and closing motions of the intake valves $V_{I1}$ and $V_{I2}$, and an exhaust valve driving means $18_3$ is provided between the exhaust valves $V_{E1}$ and $V_{E2}$ and the cam shaft 16 for converting the rotational motion of the cam shaft 16 into the opening and closing motions of the exhaust valves $V_{E1}$ and $V_{E2}$.

The intake valve driving means $17_3$ comprises a first driving rocker arm $24_3$ operatively connected to the first intake valve $V_{I1}$, and a second driving rocker arm $25_3$ operatively connected to the second intake valve $V_{I2}$ and disposed adjacent the first driving rocker arm $24_3$. The rocker arms $24_3$ and $25_3$ are swingably carried at their intermediate portions by the rocker shaft 27. The exhaust valve driving means $18_3$ comprises exhaust valve rocker arms $29_3$ and $30_3$ which are operatively connected separately to the exhaust valves $V_{E1}$ and $V_{E2}$ and swingably carried at their intermediate portions by the rooker arm shatt 28.

A connection switchover mechanism 50' is provided in the intake valve driving means $17_3$ for switching-over the connection and disconnection of the rocker arms $24_3$ and $25_3$ and comprises a connection piston 83 movable in responsive to a hydraulic pressure from the hydraulic pressure supply passage 58 provided in the rocker arm shaft 27 between a position in which the first and second driving rocker arms $24_3$ and $25_3$ are connected and a position in which such connection is released, a restricting member 84 slidably received in the second driving rocker arm $25_3$ and abutting against the connecting piston 83, and a return spring 85 interposed between the restricting member 84 and the second driving rocker arm $25_3$ to bias the connecting piston 83 and the restricting member 84 toward a disconnecting side.

In the intake valve driving means $17_3$, a roller 81 is pinned at one end of the first driving rocker arm $24_3$ to come into rolling contact with the cam 79 integrally provided on the cam shaft 16, and a slipper 82 is provided at one end of the second driving rocker arm $25_3$ to come into sliding contact with a raised portion 80 integrally provided on the cam shaft 16 adjacent the cam 79. The raised portion 80 is basically formed to have an outer surface that is circular about the axis of the cam shaft 16, but also to have a shape such that the second intake valve $V_{I2}$ is slightly operated in an opening direction while being in a substantially closed state, when the first intake valve $V_{I1}$ is opened by the first driving rocker arm $24_3$ in a condition in which the second driving rocker arm $25_3$ is not connected with the first driving rocker arm $24_3$. Moreover, the width of the raised portion 80 in a direction along the axis of the cam shaft 16 is relatively small, and the width of the slipper 82 provided on the second driving rocker arm $25_3$ is also small in correspondence to the raised portion 80 because very little force is transmitted therebetween.

Rollers 86 and 87 are pinned at one end of each of the exhaust valve-side rocker arms $29_3$ and $30_3$ in the exhaust valve driving means $18_3$ to come into rolling contact with the exhaust valve-side cams 23, 23 provided on the cam shaft 16 on opposite sides of the cam 79 and the raised portion 80 provided on the cam shaft 16 adjacent each other, respectively.

Thus, the pair of the exhaust valve-side rocker arms $29_3$ and $30_3$ constituting the exhaust valve driving means $18_3$ are disposed on opposite sides of the intake valve driving means $17_3$ in their position opposed to the cam shaft 16, and therefore, it is possible to insure a relatively wide space between the exhaust valve rocker arms $29_3$ and $30_3$. It is also possible to dispose the exhaust valves $V_{E1}$ and $V_{E2}$ at a relatively wide distance spaced apart from each other, so that the plug pipe 65 may be disposed in the cylinder head 2 between the exhaust valves $V_{E1}$ and $V_{E2}$ as well as between the exhaust valve-side rocker arms $29_3$ and $30_3$.

Figure 9:
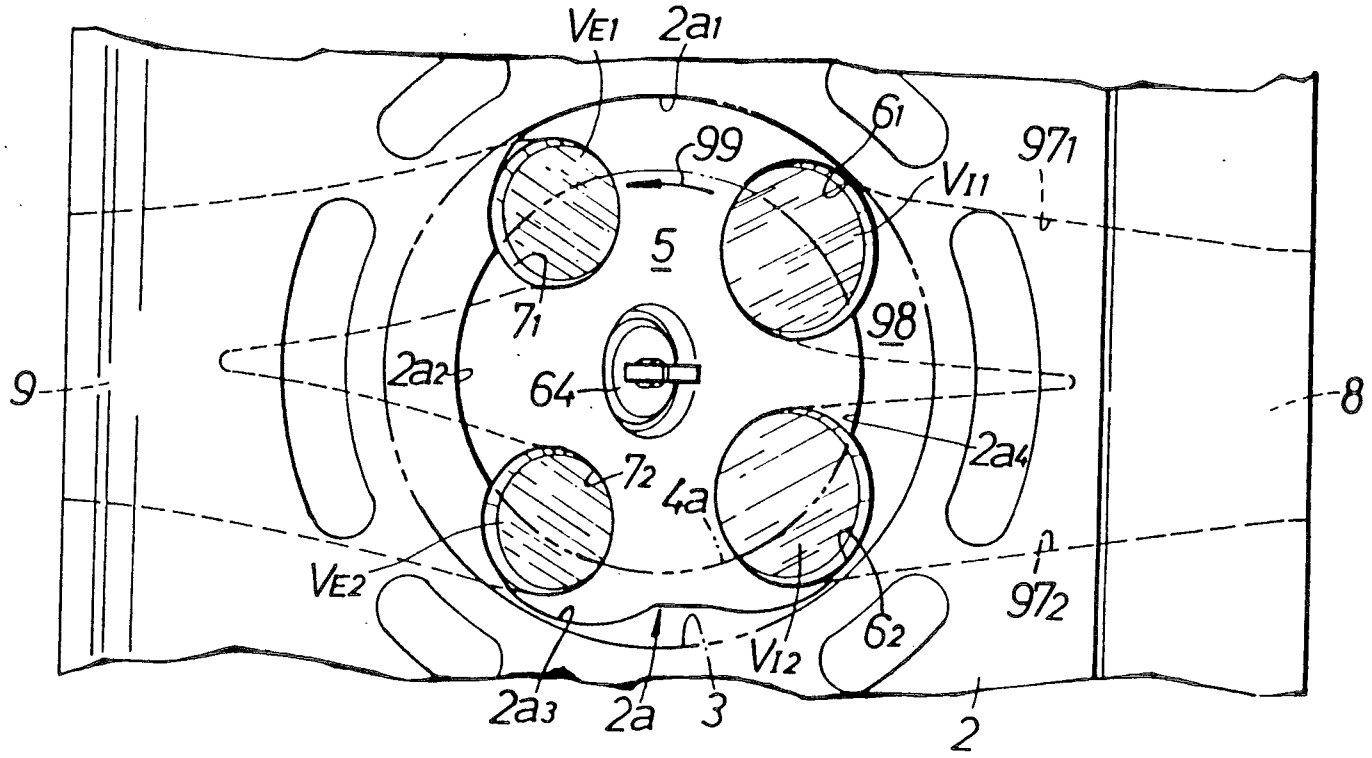
Figure 9A:
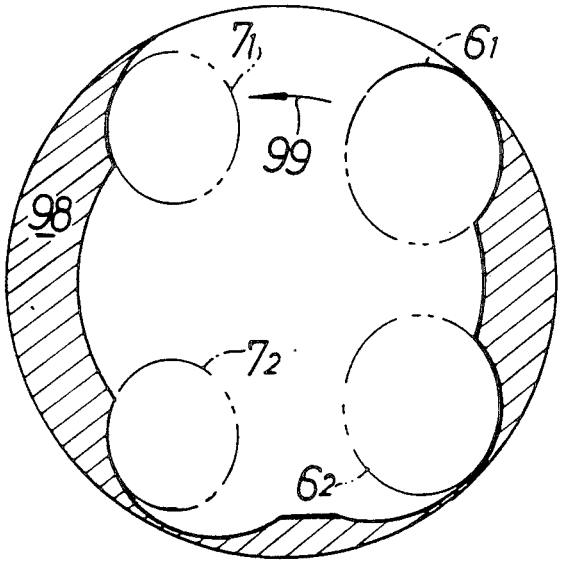
FIG. 9A is a diagram illustrating the shape of a squish area.
Figure 10:
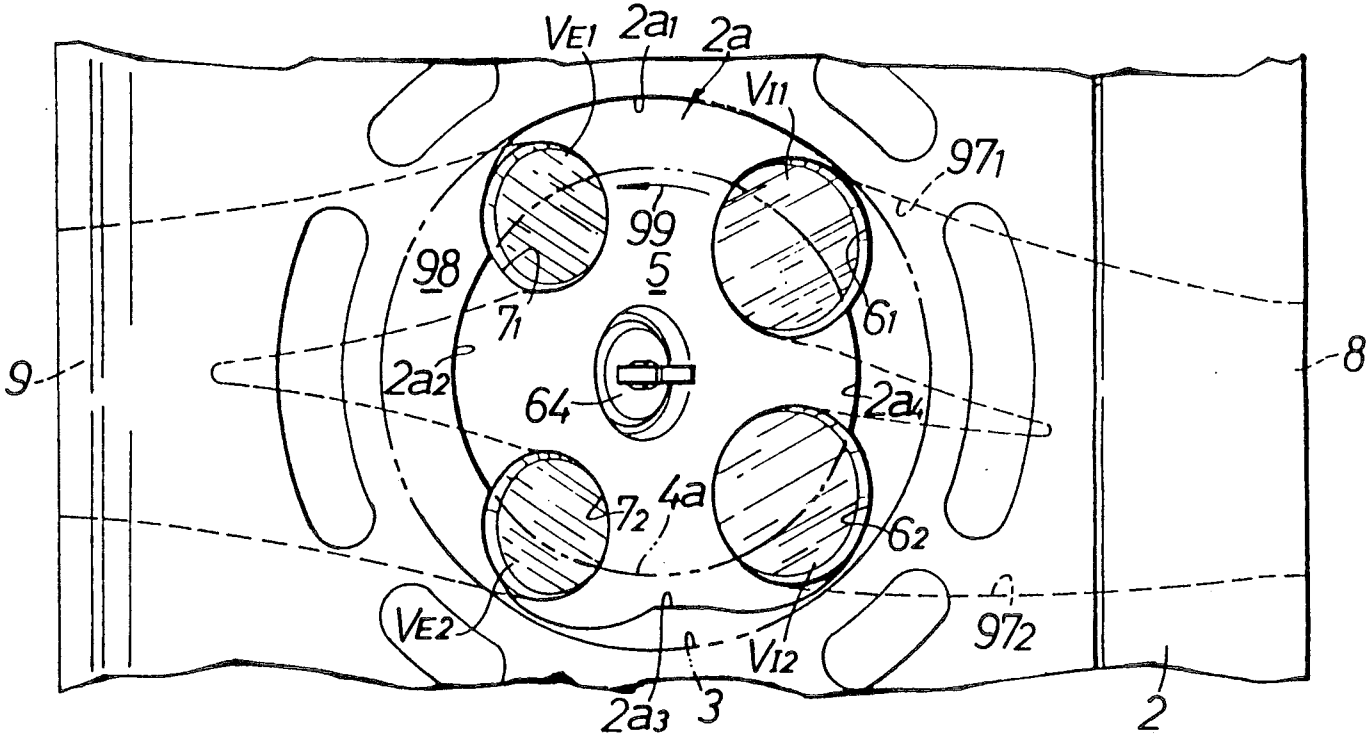
FIG. 10 is a bottom view of a cylinder head, similar to FIG. 9, but illustrating a modification of an intake passage.

Referring also to the FIG. 9, an intake passage $97_1$ provided in the cylinder head 2 in communication with the first intake valve opening $6_1$ and an intake passage $97_2$ provided in the cylinder head 2 in communication with the second intake valve opening $6_2$ are commonly connected to an intake port 8 provided in one side surface of the cylinder head 2 for each cylinder 3. One of the intake passages, such as passage $97_1$, is formed in an inwardly expanded and curved fashion to extend along the inner surface of the combustion chamber 5 just in front of the first intake valve opening $6_1$, in order to provide a swirl suction of the gas from the first intake valve opening $6_1$ into the combustion chamber 5, when the second intake valve $V_{I2}$ has become substantially inoperative.

A recess 2a is provided on a lower surface of the cylinder head 2 to form a ceiling surface of the combustion chamber 5, and a squish area 98 is provided between an opened edge of the recess 2a and a top surface of the piston 4 at the top dead center point. The opened edge of the recess 2a is shaped such that the following edge portions are connected together: a first peripheral edge $2a_1$ corresponding to an inner periphery of the cylinder extending from the first intake valve opening $6_1$ to the first exhaust valve opening $7_1$ in a direction 99 of swirl suction from the first intake valve opening $6_1$ into the combustion chamber 5; a second peripheral edge portion $2a_2$ corresponding to a peripheral edge of the circular depression 4a in the piston 4 between the first and second exhaust valve openings $7_1$ and $7_2$; a third peripheral edge portion $2a_3$ irregularly connected between an inner periphery of the cylinder and the peripheral edge of the depression 4a between the second exhaust valve opening $7_2$ and the second intake valve opening $6_2$; and a fourth peripheral edge portion $2a_4$ corresponding to the peripheral edge of the depression 4a between the second and first intake valve opening $6_2$ and $6_1$. Therefore, the squish area 98 has a shape as shown by the cross-hatched region in FIG. 9A and is not formed in a section extending from the first intake valve opening $6_1$ to the first exhaust valve opening $7_1$ in the direction 99 of swirl suction. In those portions of the squish area 98 which correspond to between the intake valve openings $6_1$ and $6_2$ and between the exhaust valve openings $7_1$ and $7_2$, the inner periphery of the squish area 98 is opposed to the peripheral edge of the recess 4a at the upper and central portion in the piston 4.

With such third embodiment, in a higher speed operation condition of the engine, the first and second driving rocker arms $24_3$ and $25_3$ can be interconnected, so that the intake valves $V_{I1}$ and $V_{I2}$ can be opened and closed at a timing and a lift amount suitable for higher speed operation by the shape of the cam 79. On the other hand, in a lower speed operational condition of the engine, the connection of the first and second driving rocker arms $24_3$ and $25_3$ can be released, so that the first intake valve $V_{I1}$ can be opened and closed at the timing and lift amount corresponding to the shape of the cam 79 by the first driving rocker arm $24_3$ in slide contact with the cam 79, while the second driving rocker arm $25_3$ in slide contact with the raised portion 80 can be brought into a substantially inoperative state to put the second intake valve $V_{I2}$substantially out of operation. However, the second intake valve $V_{I2}$ is not completely inoperative and can be slightly operated in the opening direction when the first intake valve $V_{I1}$ is opened. This makes it possible to prevent sticking of the second intake valve $V_{I2}$ to the valve seat which may be otherwise produced when a completely closed state is maintained.

In the lower speed operational condition of the engine in which the second intake valve $V_{I2}$ is substantially inoperative and only the first intake valve $V_{I1}$ is opened and closed, a fuel-air mixture from the intake port 8 is supplied via the intake passage $97_1$ and the first intake valve opening $6_1$ into the combustion chamber 5, so that a swirl is produced in the combustion chamber 5. Moreover, the intake passage $97_1$ is formed in a curved fashion to extend tangentially along the inner surface of the combustion chamber 5 just in front of the first intake valve opening $6_{11}$, so that the fuel-air mixture is drawn into the combustion chamber 5 while being whirled, enabling a swirl to be produced effectively.

The fuel-air mixture introduced into the combustion chamber 5 through the first intake valve opening $6_1$ flows within the combustion chamber 5 in the direction of swirl suction, but because the squish area 98 is not formed in the section from the first intake valve opening $6_1$ to the first exhaust valve opening $7_1$ in the direction 99 of swirl suction, a squish flow can be prevented from acting on the whirled flow just introduced into the combustion chamber 5 through the first intake valve opening $6_1$ in a direction that otherwise would disturb the whirling of such flow, thereby effectively forming a swirl in the combustion chamber 5.

Further, the inner periphery of the squish area 98 is formed in opposition to the peripheral edge of the depression 4a at the central portion of the upper surface of the piston 4 between the intake valve openings $6_1$ and $6_2$ as well as between the exhaust valve openings $7_1$ and $7_2$ and therefore, a whirled flow is easily produced along the inner surface of the combustion chamber 5, which makes it possible to form a more effective swirl within the combustion chamber 5.

It is possible to provide an improvement in burning property by forming a powerful swirl within the combustion chamber 5 in this manner.

It should be noted that the first driving rocker arm $24_3$ which is in operation in a lower speed region in which the component, in the valve operating system, of the friction loss in the entire engine constitutes a larger proportion is in rolling contact with the cam 79 through the roller 81, and this can contribute to a reduction in friction loss due to the valve operating system in the lower speed region and thus a reduction in friction loss in the entire engine. Moreover, because the exhaust valve-side rocker arms $29_3$ and $30_3$ constituting the exhaust valve driving means $18_3$ is also in rolling contact with the exhaust valve cams 23, 23 through the rollers 86 and 87, it is possible to further reduce the friction loss in the lower speed region.

Further, the second driving rocker arm $25_3$ is in slide contact with the raised portion 80 through the slipper 83 and this ensures that the width of the slipper 83 can be smaller than that of the roller 81. Moreover, because the intake valve driving means $17_3$ is comprised of the pair of driving rocker arms $24_3$ and $25_3$, such intake valve driving means $17_3$ can be constructed more compactly along the axis of the cam shaft 16, as compared with the intake valve driving means constructed of three rocker arms as in the previously described first and second embodiments.

Moreover, as in the previous embodiments, the entire construction can be made compact, notwithstanding the provision of the connection switchover mechanism 50' in the intake valve driving means $17_3$.

In the above third embodiment, the intake passage $97_1$ has been formed in the curved fashion just in front of the first intake valve opening $6_1$, but it will be understood that the intake passage $97_1$ may be disposed with the position of the intake port 8 being displaced toward the second intake valve opening $6_2$, as compared with FIG. 9, so as to extend substantially along the inner surface of the combustion chamber 5 over the entire length of the passage from the connection with the intake port 8 to the first intake valve opening $6_1$.

Figure 11:
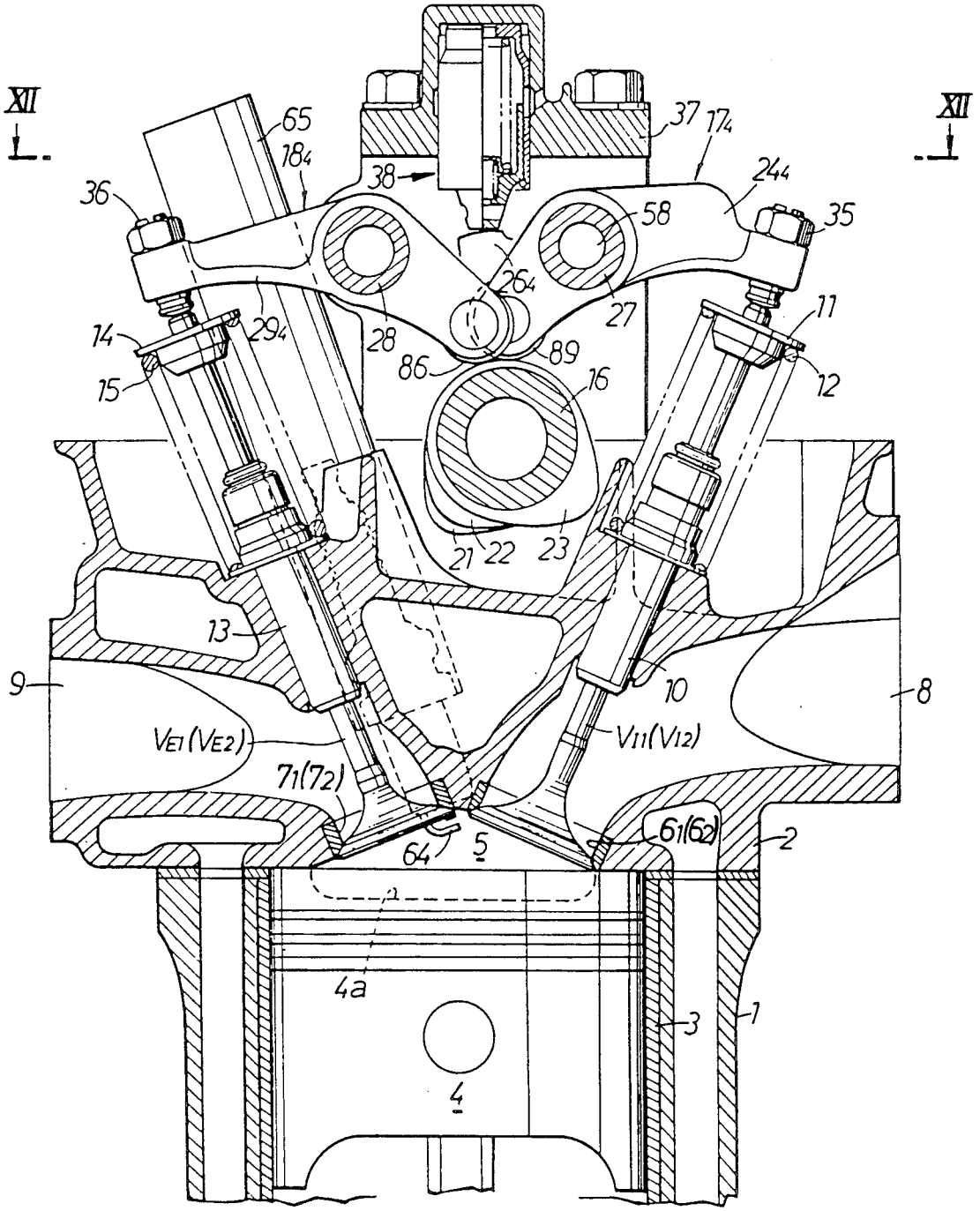
Figure 12:
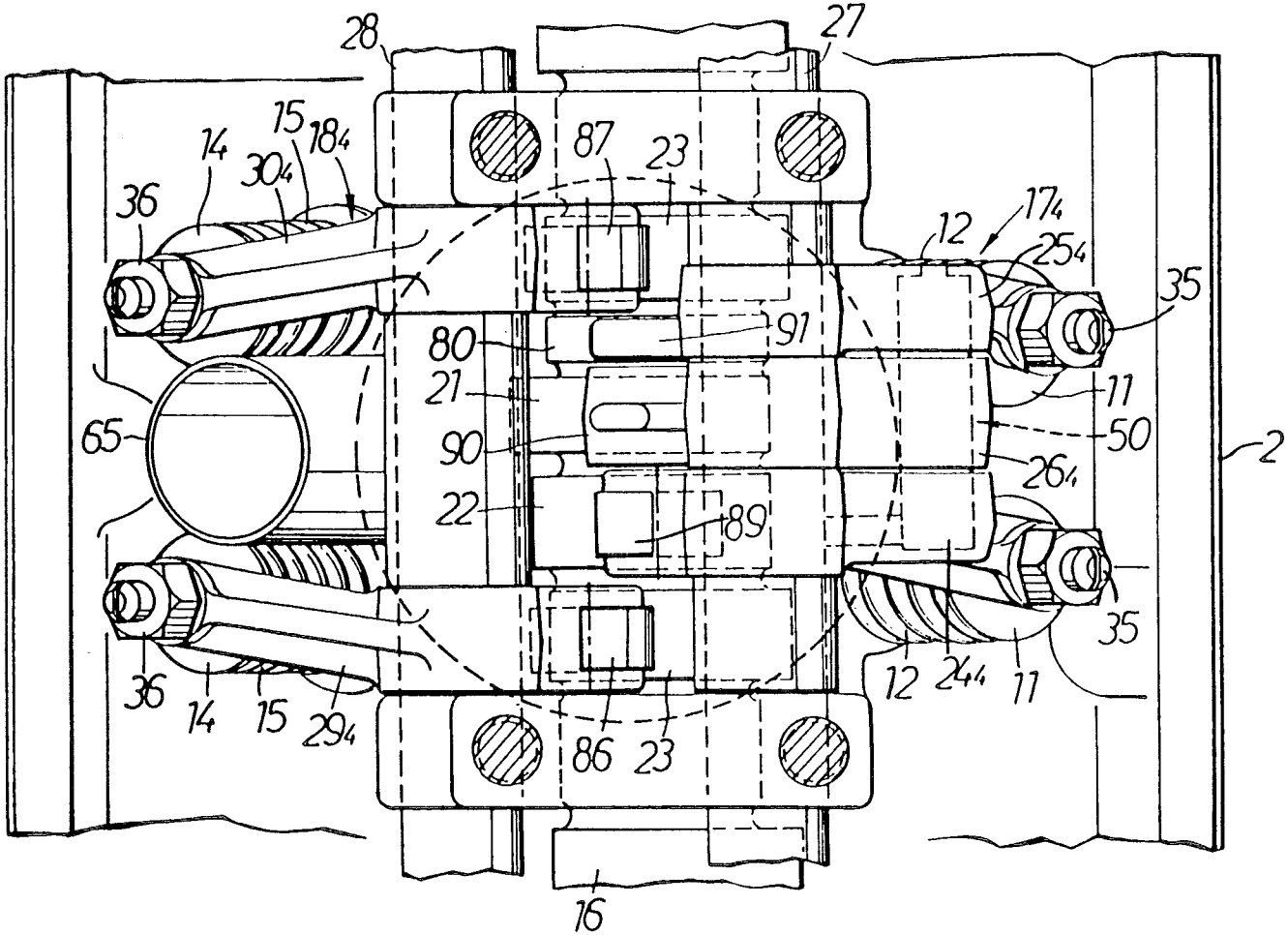

FIG. 11 and 12 illustrate a fourth embodiment of the present invention, wherein parts that are similar or identical to those in the previous embodiments are identified by the same reference characters.

An intake valve driving means $17_4$ is provided between the cam shaft 16 and the intake valves $V_{I1}$ and $V_{I2}$ for converting the rotational motion of the cam shaft 16 into the opening and closing motions of the intake valves $V_{I1}$ and $V_{I2}$, and an exhaust valve driving means $18_4$ is provided between the exhaust valves $V_{E1}$ and $V_{E2}$ and the cam shaft 16 for converting the rotational motion of the cam shaft 16 into the opening and closing motions of the exhaust valves $V_{I1}$ and $V_{E2}$.

The intake valve driving means $17_4$ comprises a first driving rocker arm $24_4$ operatively connected to the first intake valve $V_{I1}$, a second driving rocker arm $25_4$ operatively connected to the second intake valve $V_{I2}$, and a free rocker arm $26_4$ disposed between the driving rocker arms $24_4$ and $25_4$ and capable of becoming free from the intake valves $V_{I1}$ and $V_{I2}$. The rocker arms $24_4$, $25_4$ and $26_4$ are swingably carried at their intermediate portions by the rocker arm shaft 27. The exhaust valve driving means $18_4$ comprises exhaust valve-side rocker arms $29_4$ and $30_4$ which are operatively connected separately to the exhaust valves $V_{E1}$ and $V_{E2}$ and swingably carried at their intermediate portions by the rocker arm shaft 28.

A connection switchover mechanism 50 is provided in the intake valve driving means $17_4$ and is capable of switching-over the connection and disconnection of the rocker arms $24_4$, $25_4$ and $26_4$. Integrally provided on the cam shaft 16 are a higher speed cam 21 formed so that it is operative primarily during a higher speed operation of the engine, a lower speed cam 22 as a second cam formed adjacent the higher speed cam 21, so that it is operative primarily during a lower speed operation of the engine, and a raised portion 80 adjacent the higher speed cam 21 on the opposite side from the lower speed cam 22. Further, in the intake valve driving means $17_4$, a roller 89 is pinned at one end of the first driving rocker arm $24_4$ to come into rolling contact with the lower speed cam 22; a slipper 90 is provided at one end of the free rocker arm $26_4$ to come into sliding contact with the higher speed cam 21, and a slipper 91 is provided at one end of the second driving rocker arm $25_4$ to come into sliding contact with the raised portion 80. Moreover, the width of the raised portion 80 in a direction along the axis of the cam shaft 16 is relatively small, and the width of the slipper 91 provided on the second rocker arm $25_4$ is also small in correspondence to the raised portion 80.

Rollers 86 and 87 are pinned at one end of each of the exhaust valve-side rocker arms $29_4$ and $30_4$ in the exhaust valve driving means $18_4$ to come into rolling contact with the exhaust valve cams 23, 23 provided on the cam shaft 16 on opposite sides of the lower speed cam 22 and the raised portion 80, respectively.

Thus, the pair of exhaust valve-side rocker arms $29_4$ and $30_4$ constituting the exhaust valve driving means $18_4$ are disposed on opposite sides of the intake valve driving means $17_4$ in positions opposed to the cam shaft 16 and therefore, it is possible to insure a relatively wide space between the exhaust valve rocker arms $29_4$ and $30_4$. In addition, the exhaust valves $V_{E1}$ *and* $V_{EZ}$ can be disposed at a relatively large distance apart from each other, so that the plug pipe 65 may be positioned in the cylinder head 2 between the exhaust valves $V_{E1}$ and $V_{E2}$ as well as between the exhaust valve-side rocker arms $29_4$ and $30_4$.

With such fourth embodiment, in a higher speed operational condition of the engine, the first and second driving rocker arms $24_4$ and $25_4$ and the free rocker arm $26_4$ are interconnected, so that the intake valves $V_{I1}$ *and* $V_{I2}$ can be opened and closed at a timing and a lift amount corresponding to the shape of the higher speed cam 21. In a lower speed operational condition of the engine, the connection of the first driving rocker arm $24_4$ and the free rocker arm $26_4$ as well as the connection of the free rocker arm $26_4$ and the second driving rocker arm $25_4$can be released, so that the first intake valve $V_{I1}$ can be opened and closed at a timing and a lift amount corresponding to the shape of the lower speed cam 22 by the first driving rocker arm $24_4$ which is in rolling contact with the lower speed cam 22, while the second driving rocker arm $25_4$ in sliding contact with the raised portion 80 can be brought into a substantially inoperative state to put the second intake valve $V_{I2}$ substantially out of operation.

The first driving rocker arm $24_4$ operative in a lower speed region is in rolling contact with the lower speed cam 22 through the roller 89, which can contribute to a reduction in friction loss in the valve-operating system in the lower speed region and thus a reduction in friction loss in the entire engine. In addition, because the exhaust valve-side rocker arms $29_4$ and $30_4$ are also in rolling contact with the exhaust valve cam 23, 23 through the rollers 86 and 87, it is possible to provide a further reduction in friction loss in the lower speed region.

Further, the second driving rocker arm $25_4$ is in sliding contact with the raised portion 80 through the slipper 91 and therefore, the width of the slipper 91 can be smaller than that of the roller 89. This ensures that the intake valve driving means $17_4$ can be constructed more compactly along the axis of the cam shaft 16, as compared with those in the previous first and second embodiments.

Moreover, the entire arrangement can be made compact as in the previous embodiments, notwithstanding the provision of the connection switchover mechanism 50 in the intake valve driving means $17_4$.

In the foregoing embodiments, the connection switchover mechanism has been described as being provided in the rocker arms constituting the intake valve driving means for switching-over the connection and disconnection of all the rocker arms, but it will be understood that the connection switchover mechanism may be constructed to switch-over the connection and disconnection of only a pair of adjacent rocker arms.

What is claimed is:

1. An SOHC type internal combustion engine comprising:

an intake valve driving means interposed between a single cam shaft rotatably disposed above a combustion chamber and a pair of intake valves for converting the rotational motion of the cam shaft into the opening and closing motions of the intake valves;

an exhaust valve driving means interposed between the cam shaft and a pair of exhaust valves for converting the rotational motion of the cam shaft into the opening and closing motions of the exhaust valves; and a plug-insertion cylindrical portion disposed in a cylinder head for insertion of a spark plug at a central portion of a ceiling surface of said combustion chamber, wherein said intake valve driving means comprises a plurality of rocker arms disposed adjacent one another and including a pair of driving rocker arms operatively connected separately to the intake valves, and a connection switchover mechanism capable of switching-over the connection and disconnection of the adjacent rocker arms in accordance with the operational condition of the engine, and said exhaust valve driving means comprises a pair of exhaust valve-side rocker arms operatively connected separately to the exhaust valves and disposed on opposite sides of the intake valve driving means with respect to said cam shaft.

2. An SOHC type internal combustion engine according to claim 1, wherein said plug-insertion cylindrical portion is disposed in the cylinder head to have an axis inclined so that an upper portion thereof is spaced from the cam shaft between axes of the exhaust valves.

3. An SOHC type internal combustion, engine according to claim 1, wherein said intake valve driving means comprises a first and a second driving rocker arm which are operatively connected separately to the intake valves and disposed adjacent each other, said first driving rocker arm including a roller pinned thereon for rolling contact with a cam provided on the cam shaft, said second driving rocker arm including a slipper provided thereon for sliding contact with a raised portion provided on the cam shaft adjacent said cam, said raised portion being formed to substantially discontinue the opening and closing operation of the intake valve operatively connected to the second driving rocker arm, when the connection of the second and first driving rocker arms is released.

4. An SOHC type internal combustion engine according to claim 1, wherein said intake valve driving means comprises a first and a second driving rocker arm which are operatively connected separately to the intake valves, and a free rocker arm disposed between the driving rocker arms and capable being free from the intake valves, and the cam shaft is provided with a first cam operative primarily for a high speed operation of the engine, and a second cam adjacent the first cam and operative primarily for low speed operation of the engine, and a raised portion adjacent the first cam on an opposite side from the second cam, said free rocker arm including a cam slipper provided thereon for sliding contact with said first cam, said first driving rocker arm having a roller pinned thereon for rolling contact with said second cam, said second driving rocker arm including a slipper provided thereon for sliding contact with said raised portion, and said raised portion being formed to substantially discontinue the opening and closing operation of the intake valve operatively connected to said second driving rocker arm when the connection of the second driving rocker arm with the free rocker arm is released.

5. In an SOHC type internal combustion engine having a single cam shaft rotatably mounted in a cylinder head above a combustion chamber, a pair of intake valves mounted in said cylinder head on one side of said cam shaft, a first pair of driving rocker arms operatively connecting said cam shaft to said pair of intake valves separately, a pair of exhaust valves mounted on said cylinder head on the other side of said cam shaft, a second pair of driving rocker arms operatively connecting said cam shaft to said pair of exhaust valves separately, and a spark plug mounting hole in a central portion of a ceiling of the combustion chamber, an improvement comprising;

the first pair of driving rocker arms positioned between the second pair of driving rocker arms, and means for selectively connecting and disconnecting said first pair of driving arms.

6. The SOHC type internal combustion engine according to claim 5 wherein a spark plug insertion pipe is provided between said second pair of driving rocker arms and extends to the spark plug mounting hole.

7. The SOHC type internal combustion engine according to claim 5 wherein a free rocker arm is provided between said first pair of rocker arms and said means also selectively connects and disconnects said free rocker arm to the first pair of driving rocker arms.

* * * * *